United States Patent [19]

Welk

[11] 4,129,849

[45] Dec. 12, 1978

[54] FAULT CURRENT LIMITING RESISTOR

[75] Inventor: Steven Welk, Lansdale, Pa.

[73] Assignee: Electric Power Research Institute, Inc., Palo Alto, Calif.

[21] Appl. No.: 793,306

[22] Filed: May 3, 1977

[51] Int. Cl.[2] ..... H61C 7/13

[52] U.S. Cl. ..... 338/21; 338/270; 338/298; 338/299; 338/304

[58] Field of Search ..... 338/20, 21, 61–63, 338/267, 270, 296, 298, 299, 302, 304; 29/610

[56] References Cited

U.S. PATENT DOCUMENTS 1,406,393 2/1922 Johnston ..... 338/299 X 3,074,042 1/1963 McNeir et al. ..... 338/61 X

FOREIGN PATENT DOCUMENTS 596266 12/1947 United Kingdom ..... 338/62

*Primary Examiner*—C. L. Albritton

*Attorney, Agent, or Firm*—Flehr, Hohbach, Test, Albritton & Herbert

[57] ABSTRACT

A fault current limiting resistor for high energy dissipation includes a frustro-conical support structure where the resistor wire is wound on the support structure in the form of a three dimensional spiral. This provides optimum voltage clearances even when the wire may sag due to thermal expansion.

7 Claims, 8 Drawing Figures

FAULT CURRENT LIMITING RESISTOR

BACKGROUND OF THE INVENTION

The present invention is directed to a fault current limiting resistor and more particularly to a resistor which can dissipate high levels of fault current energy.

The use of resistors of wire in a fault current limiter to dissipate high levels of fault current energy results in a resistor element that is of considerable weight and length. Since high levels of energy are being dissipated, high operating temperatures are characteristic of this type of resistor element. Such high operating temperature has the following important design considerations: spacing between windings, thermal expansion, sag, accelerated oxidation, accelerated corrosion, high temperature tensile strength, high temperature strength of joints and welds, and heat dissipation. In addition, from an electrical standpoint dielectric clearances and high electro-magnetic forces must be taken into account in any support structure design for this type of resistor.

Since the resistance value as well as the energy absorption requirements will vary in the power system, it can be expected that the resistor element dimensions will also change. In the past it has been difficult to accommodate such changes.

OBJECTS AND SUMMARY OF THE INVENTION

It is therefor a general object of the present invention to provide an improved fault current limiting resistor.

It is another object of the invention to provide a resistor as above which easily accommodates the high temperatures and voltages in a fault current resistor and also the various energy absorption requirements of different power systems.

In accordance with the above objects there is provided a fault current limiting resistor which comprises a relatively long resistive element of a predetermined resistance for providing high energy dissipation. The element is supported in a frustro-conical configuration. The frustroconical structure provides a three-dimensional spiral.

Detailed Description of the Preferred Embodiments

Figure 1:
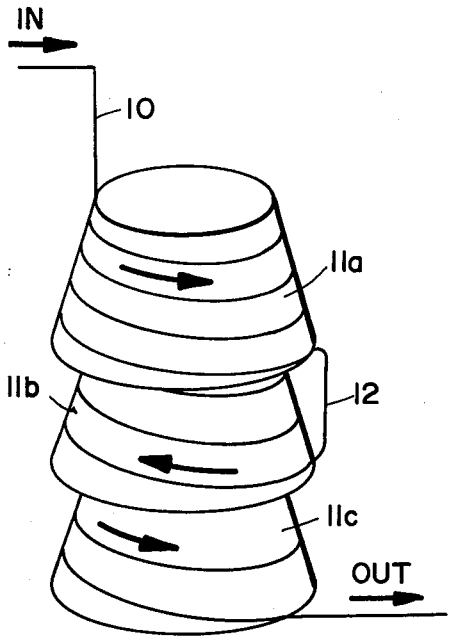
FIG. 1 is a perspective view of one embodiment of the invention.

FIG. 1 illustrates the stacked frustro-conical structure which supports a continuously wound wire resistor element 10. Element 10 may also be a ribbon, etc. This supporting structure consists of frustro-conical supports 11*a*, 11*b* and 11*c*. These supports provide a spacing between points on the resistor element which increases as the distance between these points increases in such a manner that the locus of a point which would follow the path of the resistor element has the proper dielectric clearance; in other terms it follows a three dimensional spiral. As will be discussed in detail below the pitch of the spiral is a function of the rate of increase in point to point voltage along the resistor's length. Thus the conical geometry permits the control of dielectric clearances in three dimensions.

Moreover, the conical shape geometry lends itself well to the stacking of the identical structures 11*a, b, c* one inside the other. The length of low ohmic valued resistor wire tends to be very long. The stacked structure illustrated is ideal. Specifically the winding shown in FIG. 1 is continuous. The winding on support element 11*a* is in the direction shown by the arrow. This is reversed at 12 to proceed in the opposite direction on element 11*b* to provide for a minimum inductive effect and finally on support element 11*c* the winding is again in the same direction. Such continuous winding technique provides a minimum of critical high temperature connections and insures greater reliability.

Figure 2:
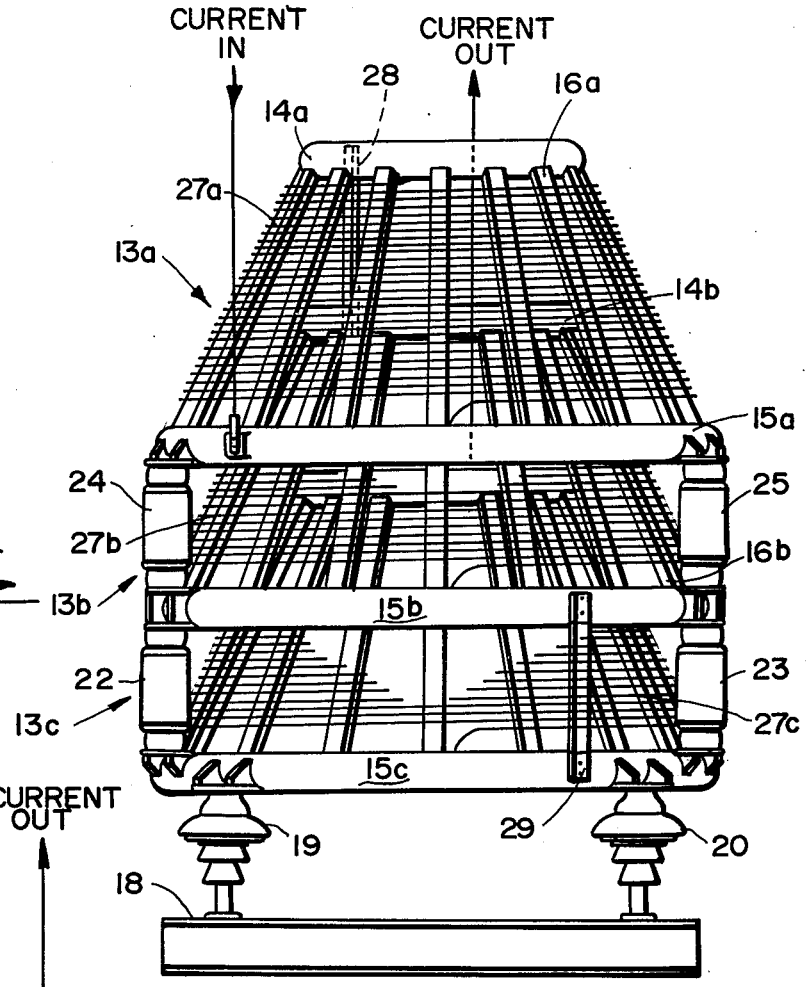
FIG. 2 is an elevation view of another embodiment of the invention.
Figure 3:
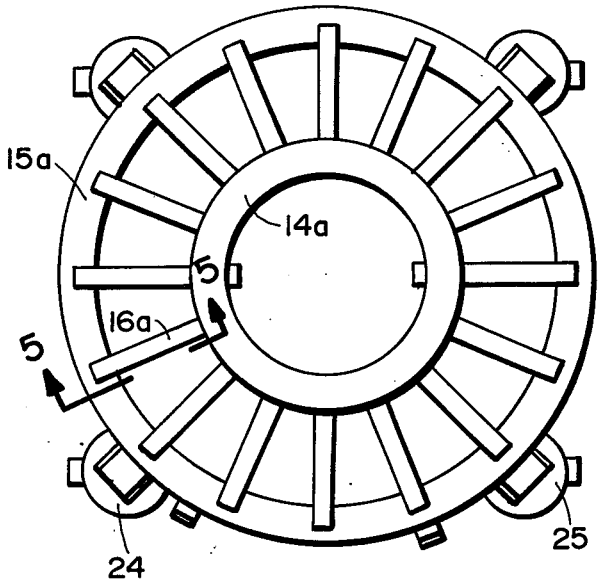
FIG. 3 is a simplified top view of a portion of FIG. 2.

However, for commercial manufacturing it is easier to simply wind the wire continuously on each conical support as illustrated in FIG. 2 which has the conical supports 13*a* through *c*. Each support member consists of small diameter tubular conductive support ring 14, a large diameter tubular conductive support ring 15 and insulator supports 16 (all of which have the corresponding subscripts). The entire stacked assembly is supported on a base 18 having insulator elements 19 and 20. Bottom ring 15*c* is mounted on supports 19 and 20, bottom ring 15*b* is spaced from 15*c* by insulator supports 22 and 23 and bottom ring 15*a* is spaced from ring 15*b* by insulator supports 24 and 25. Other supports are present but not shown. FIG. 3 is a top view of support structure 13*a* without any resistive wire. In general support structure 13 has wound on it an independent resistor 27*a* through *c* and with the appropriate support rings being interconnected electrically by the high current braids 28 and 29.

Figure 4:
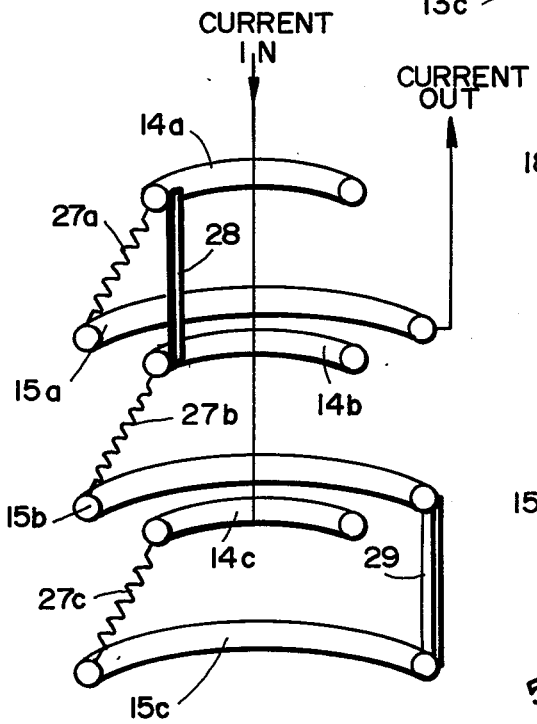
FIG. 4 is a simplified circuit schematic of FIG. 2.

FIG. 4 is electrically equivalent to FIG. 2 clearly illustrating the electrical connection of the various elements which, of course, have the same reference numerals.

Figure 5:
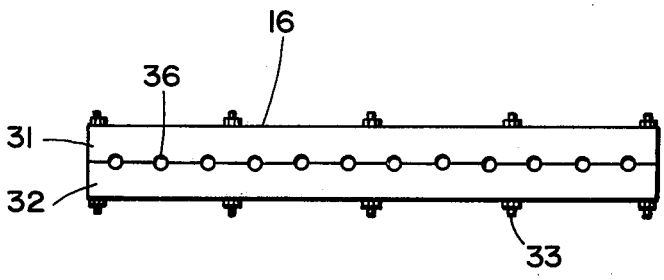
FIG. 5 is an elevation view of an element portion of FIG. 3 taken substantially along the lines 5—5.
Figure 6:
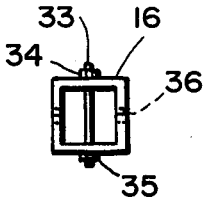
FIG. 6 is an end view of FIG. 5.

Referring now to FIGS. 5 and 6 a typical insulator support 16 is illustrated which is tubular consisting of U-shaped channels 31 and 32. They are connected by threaded insulating rods 33 having nuts 34 and 35. Several holes 36 are punched through the tubular walls to retain the resistor wire. The two piece construction of the tubular supports makes it possible to wind the resistance wire onto a mandrel formed by one-half of the insulator support and the other half can then be replaced.

Figure 7:
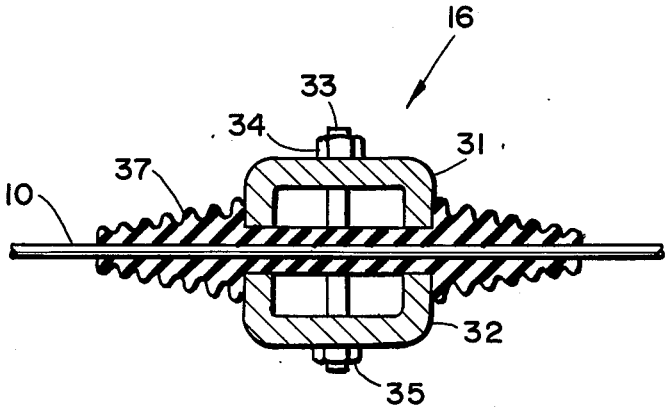
FIG. 7 is a detailed view of FIG. 5 showing an inserted resistor wire.

A further manufacturing standardization can be effected by standardizing the size of the holes that are punched in the supports. Various wire sizes can be accommodated as illustrated in FIG. 7 by using a split ceramic wire support sleeve 37 with an outside diameter corresponding to that of the holes 36 in the supports and the inside diameter corresponding to resistance wire 10. Ceramic sleeve 37 provides additional support along the length of the wire as well as thermal insulation between the wire and support 16. Other forms of inserts, sleeves or spacers would also allow the frustro-conical structure to accommodate a wide variety of wire diameters.

Referring briefly to FIG. 3 both support rings 14 and 15 are formed by bending an aluminum tube into a ring shape and welding the ends together. Terminal pads and insulator mounting pads for mounting the tubular supports 16 may also be welded on. Since both rings 14 and 15 are conductors, the beginning and termination points of the resistor wire can be located anywhere along these rings. Similarly, the interconnection of any stacked resistor structures (where there is no continuous winding) may be easily done by clamping or welding busses or braids at any point on the support rings as is illustrated in FIG. 2. Finally the base rings 15 have a large mass to act as a good heat radiator to prevent buildup of heat.

Spiral Voltage Clearance Calculation

Figure 8:
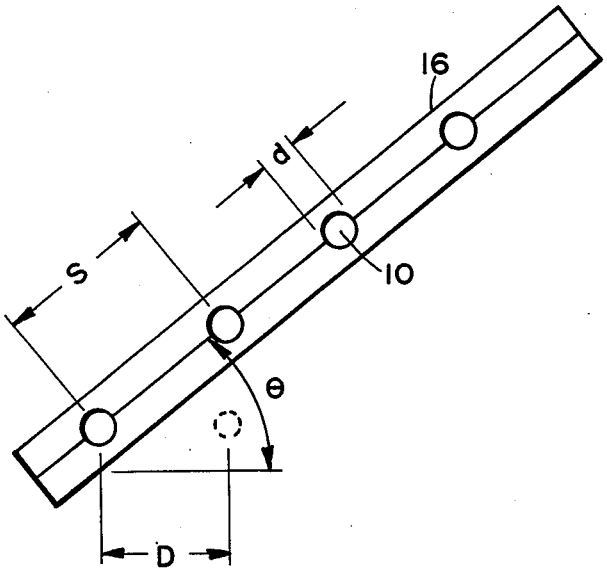
FIG. 8 is a diagrammatic showing of FIG. 5 useful in understanding the critical parameters of the invention.

The primary design paramter of the resistor structure of the present invention is, of course, safe voltage clearance. The critical spacing is calculated using as an approximation the first turn voltage drop where the initial radius of the spiral is $r_0$. There are two critical clearances. These are illustrated in FIG. 8 where a typical insulator support element 16 is retaining the wire 10 and is tilted at an angle $\theta$ from the horizontal. The first distance designated S is the distance between the center point of two loops of the wire in the insulator support 16 and is the surface voltage clearance. The second designated D is an open gap voltage clearance which occurs in air and is due to the sagging of a wire 10 as indicated from thermal expansion. In other words, this is the worst case wire sag condition.

Thus, the minimum spacing between wires is determined by the creepage voltage clearance S along the support members. And since the high temperature wire sag condition requires a minimum open gap voltage clearance D the critical optimum angle of the support 16 is determined by the two independent factors S and D. A distinct advantage of the conical configuration of the present invention is that the clearance D is independent of the amount of sag the wire actually experiences since more sag, referring to FIG. 8, would not increase the open gap voltage clearance requirement.

The factor S can be calculated as follows. In general the critical voltage is the product of the peak let through current multiplied by the resistance of the base turn of wire which is $$V_{CRITICAL} = (2\pi r_0) \times (\Omega/\text{ft.})_{wire} \times I_{peak} \quad (1)$$

It is, of course, obvious that the minimum dielectric clearance is determined by the product of $V_{CRITICAL}$ multiplied by the surface voltage clearance factor, $f_S$. In order to account for the increase in turn to turn wire length, wire diameter, and contamination, a safety factory $f_{SAFE}$, is applied to the surface voltage clearance factor. Then the diameter, $d$, of the wire is added so that the final dielectric clearance S is $$S = (V_{CRITICAL} \times f_S \times f_{SAFE}) + d \quad (2)$$

Next the critical spacing D is calculated and this clearance corresponds to the open gap dielectric strength, $f_{og}$, of either air or an insulating gas. This is shown in equation (3).

$$D = (V_{CRITICAL} \times f_{og} \times f_{SAFE}) + d \quad (3)$$

The foregoing relationships define minimum values for resistor element separation. Thus the critical or maximum value of the angle $\theta$ is $$\theta = \text{Arc cos}(D/S) \quad (4)$$

Angles greater than $\theta$ will not provide proper dielectric clearance. The angle is measured from the horizontal axis to the center line of a support member. The horizontal axis lies in the plane of the smaller radius $r_0$.

The determination of the length of the spirally wound wire is a function of the number of turns and is relatively straightforward. If the length of a single turn of wire which starts at an initial radius $r_0$ and must maintain an insulation spacing D, (as discussed above) is wound upon itself, it can be seen that the radius increases linearly by the use of a simple integral calculus technique. The following equation relates the length of a three dimensional spiral with known parameters.

$$L = \sqrt{[2\pi n(r_0 + nD/2)]^2 + [D\tan\theta]^2} \quad (5)$$

where $n$ is the number of revolutions, $r_0$ the initial radius, D the horizontal spacing between windings which is taken as a constant for the $n$ turns, and $\theta$ is the rate of vertical rise on the spiral which may be approximated by the angle of the insulator supports as discussed above.

If a known length, L, of wire is to be wound in the shape of a three dimensional spiral with known values for $r_0$, D and $\theta$ the number of revolutions required to do so can be found by rearranging equation (5) into a quadratic equation and solving in a known manner to produce $$n = \frac{-r_0 \pm \sqrt{r_0 + D/\pi \sqrt{L^2 - (D\tan\theta)^2}}}{D} \quad (6)$$

Thus from the foregoing the following advantages are known for the present invention:

1. The layered spiral winding technique utilizes the volume which it occupies in an extremely efficient manner.
2. The reduction in dielectric clearances due to high temperature thermal expansion (wire sag) is almost completely eliminated by the unique geometry of the conical configuration.
3. The use of sleeves or other simple modifications to the insulator support allow a wide range of wire diameters to be supported by a frustro-conical structure without modifying the structure's dimensions. This minimizes the number of sizes of frustro-conical structures that need to be stocked.
4. Since each stacked layer is a rigid self-supporting structure, the use of the spacing insulator is between the larger diameter support rings and between the lowermost support ring and ground provides a free-standing or free-hanging and electrically isolated unit.
5. The use of tubular insulator supports provide good values for the section modulus which results in good longitudinal and lateral strength of the support elements. Tubular support rings have similar resistance to deformation. Acting together, the overall structural member which comprises in effect a conical mandrel provides an extremely sturdy configuration.
6. Since the high temperature elements are loosely packed and have some component of horizontal displacement, dissipation of heat can be easily accomplished through radiation and convection over a reasonable period of time. For example, the nearest elements are not arranged with one directly above another.

7. Since the high temperature elements (essentially the resistor wire) do have a component of horizontal displacement, and since the greatest heat intensity would be from the closest of adjacent wires, hot spots are unlikely. More specifically, there is no regenerative or positive feedback effect where, for example, a hot spot caused by the heating of one section of wire by another regenerates itself into even higher resistivity condition due to, for example, inadequate vertical clearance and in that one wire might sag even closer to another.
8. The inductance of the resistor branch is kept at a minimum by using oppositely wound spirals on alternate layers. An inherent advantage of the spiral winding is that it creates a higher percentage of partial flux linkages due to extremely loosely packed turns (as compared to standard winding techniques that use uniform turn spacings).
9. Connection to the power system at the tubular base ring conductor provides a large heat sinking mass which serves to limit the temperature rise at the connection points.
10. Since the resistor element becomes an integral part of the support structure, sudden or uneven distribution of forces will be shared by all structural members thereby maintaining structural integrity during dynamic conditions.
11. The tubular ring conductors of the layered or stacked structure provide a simple means of shorting between resistor layers so that the effective value of resistance can be varied.
12. The center of the resistor structure provides an area for feedthrough conductors, a small bypass switch or other fault current limiter components.
13. The resistor support need only be supported and insulated on one end.
14. The resistor support is capable of supporting other devices around its structure.
15. The ring conductors release the constraints on the start and end points of the resistor element to thereby provide for the use of a standard mandrel for a wide range of resistor lengths; viz using wider interwinding spacings than dielectrically required for shorter element lengths.

What is claimed is:

1. A fault current limiting resistor comprising a relatively long resistive element of a predetermined resistance for providing high energy dissipation; means for supporting said element in a frustro-conical configuration, said support means including a large diameter base ring, a spaced small diameter support ring, a plurality of insulator elements joining said rings and having a frustro-conical configuration, and means for affixing said resistive element to said insulator elements.

2. A resistor as in claim 1 where there are stacked a plurality of said support means.

3. A resistor as in claim 2 where said stacking is one inside the other.

4. A resistor as in claim 1 where said base ring is conductive and has a large mass to prevent build-up of heat.

5. A resistor as in claim 1 where said insulator elements are at an angle from the horizontal less than a critical angle determined by the horizontal spacing between adjacent loops of said resistive element when one has sagged due to thermal expansion.

6. A resistor as in claim 5 where said angle is also determined by the creepage voltage clearance between resistive element loops on an insulator element.

7. A fault current limiting resistor comprising: a relatively long element of a predetermined resistance for providing high energy dissipation; means for supporting said element in the form of a three dimensional spiral where the pitch of said spiral is a function of the rate of increase in point-to-point voltage along the resistor's length.

* * * * *